US005517338A

United States Patent [19]

Vaughn et al.

[11] Patent Number: 5,517,338

[45] Date of Patent: May 14, 1996

[54] COMPOSITE MIRRORS

[75] Inventors: George D. Vaughn, Chesterfield; Charles R. Graham, St. Peters, both of Mo.

[73] Assignee: Monsanto Company, St. Louis, Mo.

[21] Appl. No.: 963,650

[22] Filed: Oct. 20, 1992

[51] Int. Cl.[6] ..... G02B 5/32

[52] U.S. Cl. ..... 357/15; 359/1; 359/566; 359/572

[58] Field of Search ..... 359/1, 15, 566, 359/572; 428/208, 209; 427/304, 404; 369/100, 103

[56] References Cited

U.S. PATENT DOCUMENTS

| | | | |
|---|---|---|---|
| 3,329,512 | 7/1967 | Shipley et al. . | |
| 4,493,861 | 1/1985 | Sirinyan et al. | 427/304 |
| 4,500,669 | 2/1985 | Ashlock et al. | 524/440 |
| 4,550,395 | 10/1985 | Carlson | 369/103 |
| 4,910,072 | 3/1990 | Morgan et al. | 428/212 |
| 5,024,927 | 6/1991 | Yamada et al. | 369/100 |
| 5,061,551 | 10/1991 | Durand | 428/209 |
| 5,087,510 | 2/1992 | Tokas et al. | 428/209 |
| 5,135,780 | 8/1992 | Kissel | 427/404 |
| 5,188,923 | 2/1993 | Ahn et al. | 430/273 |
| 5,334,292 | 8/1994 | Rajeshwar et al. | 204/59 R |

FOREIGN PATENT DOCUMENTS

| | | | |
|---|---|---|---|
| 0485910 | 5/1992 | European Pat. Off. | H05K 3/34 |
| 56-70883 | 6/1981 | Japan | B05D 7/14 |
| 56-70884 | 6/1981 | Japan | B05D 7/14 |
| 2231884 | 11/1990 | United Kingdom | C23C 18/08 |
| 2253635 | 9/1992 | United Kingdom | C23C 18/08 |
| 2253636 | 9/1992 | United Kingdom | C23C 18/08 |

OTHER PUBLICATIONS

St. Clair et al. "Electrically Conductive Polyimide Films Containing Palladium Coordination Complexes", JACS, 102:2, Jan. 16, 1980.

*Primary Examiner*—Georgia Y. Epps
*Assistant Examiner*—Michael A. Papalas
*Attorney, Agent, or Firm*—Thomas E. Kelley

[57] ABSTRACT

Composite mirrors on a substrate comprising a mixture of up to 20 percent of polymer and at least 80 percent of metal clusters, e.g. of gold, palladium or silver, which have a nominal diameter less than 100 nanometers and which are agglomerated in a layer conforming to the surface of the substrate. Composite mirrors are produced by coating a substrate with a solution comprising at least 80 percent solvent, e.g. water and alcohol, and up to 20 percent of a mixture of up to 20 percent polymer, e.g. methylcellulose, and at least 80 percent metal, present as a salt of volatiles-forming anion, e.g. silver lactate or palladium acetate; dry films of polymer and salt are exposed to heat or ultraviolet light to convert the salt to metal clusters. Polymeric mirrors are especially useful for making reflection holograms on polymeric surfaces embossed with a latent holographic image in a relief pattern.

3 Claims, 3 Drawing Sheets

COMPOSITE MIRRORS

Disclosed herein are composite mirrors comprising a mixture of polymer and agglomerated metal clusters and methods for making and using composite mirrors, especially for image reflecting holograms.

In prior practices image-reflecting mirror surfaces of metal have been applied to polymer surfaces by electroless or electrolytic deposition or vapor deposition of the metal. Electroless deposition is effected by applying a catalytic coating, e.g. of colloidal palladium or a palladium-polymer complex, to the polymer surface, activating the palladium, e.g. by application of energy and/or a reducing agent, and immersion in an electroless plating solution, e.g. of copper, cobalt or nickel. Such electroless deposition procedures are disclosed by Shipley in U.S. Pat. No. 3,329,512, by Sirinyan et al. in U.S. Pat. No. 4,493,861 and by Morgan et al. in U.S. Pat. No. 4,910,037. Electrolytic deposition of metal typically requires a conductive substrate, e.g. metal or carbon, or a conductive coating on a polymeric substrate. Certain electroless deposition technology is amenable to the manufacture of reflection holograms by depositing a metal reflecting layer on a hologram-forming relief pattern; see for instance, U.S. Pat. No. 5,087,510. Such prior art procedures for forming image-reflecting metallic mirror surfaces on polymer surfaces, including holograms, involve multiple step processes which are so inherently slow as to not be readily amenable to high speed processing.

Vapor deposition of metal surfaces, e.g. aluminum on polyester film, is typically effected in a vacuum. Although the process is fast and efficient, it is not amenable to selective metallization.

The Honda Motor Company, Ltd. disclosed solutions of metal compounds (which release metal upon heating or irradiation) and resin binders for formation of metallic gloss coating in Japanese Kokai Tokkyo Koho 81/70,884. An exemplary solution contains about 5 parts of silver lactate, and 30 parts by weight of resin binder (i.e. 24 parts of alkyd resin and 6 parts of melamine resin) in 65 parts by weight of a solvent mixture (i.e. 15 parts of methoxyethanol, 20 parts of ethyl Carbitol, 19 parts of xylene and 10 parts of toluene and 1 part of silicone oil). The solution was applied as a 40 micrometer coating to a steel plate, kept at room temperature for 20 minutes then heated to 80° C. to form a smooth surface layer possessing luster, where the coating comprised colloidal particles of silver lactate (2–3 micrometers) mixed in the resin. When the coating was heated for 30 minutes at 200° C., the silver lactate decomposed providing a polymer film with a continuous surface layer of silver (0.05–0.1 micrometer thick) with a high reflectance of visible light. The Honda process for forming image-reflecting metallic mirrors involves unfavorably long thermal processing times and utilizes such a large amount of polymer that the rapid production of thin layered mirrors necessary for hologram production is not feasible.

St. Clair et al report in JACS, 102:2, p 866–8, the use of palladium salts, e.g. bis(dimethyl sulfide)dichloropalladium(II), as a source of a metal dopant for polyamic acid resin (polyimide precursor); solutions of the materials were cast into palladium-polyamic acid complex films which were heated at length, e.g. for about 3 hours at 200° to 300° C., to form palladium-polyimide complex films, containing 5 to 7% palladium, having metallic appearance. The disadvantageously long cure times do not recommend this procedure for commercial practice.

One object of this invention is to provide high speed methods for forming image-reflecting, metallic mirror surfaces on selective areas of polymer substrates, e.g. that allow processing on polymeric webs travelling at speeds greater than 100 meters per minute.

Another object of this invention is to provide high speed application of image-reflecting, metallic mirror surfaces which can replicate the relief-patterned surface of an optically variable device such as a holographic image-forming surface on a polymeric substrate.

These and other objects and advantages of this invention will be apparent from the following description and illustrative examples of this invention.

SUMMARY OF THE INVENTION

This invention provides image-reflecting, composite mirrors consisting of a mixture of up to 20 weight percent of polymer and at least 80 weight percent of metal clusters wherein the metal clusters are agglomerated in a layer conforming to the surface of a substrate.

This invention also provides a simple process for making composite mirrors. In the process solutions of polymer and metal salt are used in a single coating step to produce a layer of polymer and salt that is treated with radiant or convective energy to provide metal clusters. Such processing is advantageously effected on substrate webs travelling at speeds greater than 30 meters per minute.

In a preferred application composite mirrors are employed as light reflecting surfaces in optically variable devices, e.g. reflection holograms, diffraction gratings, etc. An especially preferred aspect of this invention provides security documents with a hologram printed thereon, e.g. as an anti-counterfeit measure.

DETAILED DESCRIPTION OF PREFERRED EMBODIMENTS

Figure 1A:
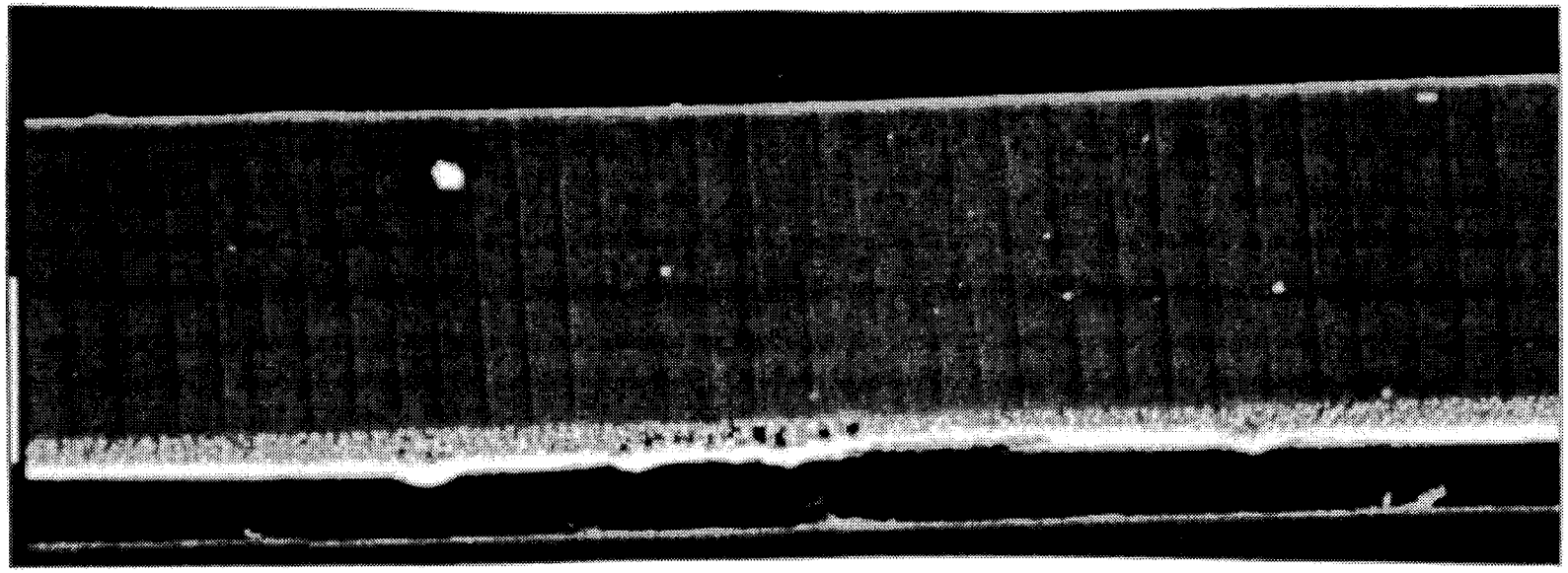
FIGS. 1A and 1B are electron photomicrographs showing the cross section of a prior art coating prepared according to Japanese Kokai Tokkyo Koho 81/70,884 comprising a polymer film with a metal surface layer.

As used herein percentages are expressed by weight unless indicated otherwise.

The composite mirrors of this invention consist of a mixture of up to 20 percent of polymer and at least 80 percent of metal clusters wherein said metal clusters are agglomerated in a layer conforming to the surface of a substrate. Such metal clusters have a nominal diameter less than 100 nanometers, preferably the clusters are generally spherical and have an average diameter less than 50 nanometers.

The composite mirrors can be applied to a variety of substrates, e.g. two dimensional surfaces such as flat films or three dimensional surfaces ranging from the external surfaces of molded parts or textile materials, e.g. woven or non-woven fabrics, to interior surfaces of foams. In preferred embodiments the composite mirror is applied to optically variable devices to provide a reflecting surface for diffraction gratings, holograms, kinegrams, color shift surfaces, filler for optically variable inks, etc. In such an application the composite mirror is applied as a thin layer which conforms to a relief-patterned surface so that light reflected from the composite mirror generates a visible image.

The composite mirrors of this invention comprise a layer that is less than 500 nanometers. In the case of many optically variable device applications the layer of polymer and agglomerated metal clusters is less than 200 nanometers, e.g. on the order of 50 to 100 nanometers thick. Accordingly the metal clusters which have a nominal diameter less than 100 nanometers will preferably have an average diameter less than 50 nanometers. Composite mirrors comprising silver clusters typically have a nominal diameter in the range of 7 to 100 nanometers. Composite mirrors comprising palladium typically have a nominal diameter in the range of 1.5 to 4.5 nanometers. The metal clusters are generally spherical in shape, i.e. have three orthogonal dimensions which are of the same order of magnitude, preferably varying less than 50% or less from each other, more preferably varying less than 20% or less from each other, as observed using electron microscopy. Being substantially spherical the clusters of the composites of this invention differ from prior art reflecting coatings comprising metal flakes. Thus, the metal clusters in composite mirrors can be in essentially a monolayer or in a layer of about two to three times the nominal diameter of the clusters. Because there is generally some size distribution of the metal clusters, the metal clusters are typically dispersed in a layer of a thickness varying between one or two and up to three times the nominal diameter of the clusters, e.g. of the average nominal diameter of the clusters.

The composite mirrors are preferably thin, e.g. less than 500 nanometers thick, preferably less than 200 nanometers thick. Low distortion reflection of electromagnetic radiation in the visible light range for optically variable devices is preferably achieved with composite mirrors having a thickness less than about 100 nanometers, e.g. in the range of about 20 to 100 nanometers thick. In especially preferred embodiments composite mirrors are applied at high speeds onto web substrates by flexoplate or gravure printing techniques which allow the production of such thin composite mirrors in the range of 20–100 nanometers thick.

The composite mirrors of this invention are substantially metal, comprising at least about 80 percent metal, e.g. up to about 95 percent metal. Especially useful metals include gold, palladium, silver or a mixture thereof, e.g. a mixture of palladium and silver or a mixture of palladium and gold. The composite mirrors contain a minor amount, e.g. up to about 20 percent, of polymer. Although the composite mirrors preferably comprise metal and polymer, they may also contain residual salt constituents, e.g anion derivatives, or reducing agents which are preferably liberated from the film during processing and other additives such as surfactants.

The composite mirrors of this invention are prepared from wet films of a solution comprising metal salt, polymer and solvent. In preferred practice of this invention the solvent is an aqueous-based solvent, e.g. water or a mixture of water and an alcohol such as methanol, ethanol, 1-propanol, 2-propanol or a mixture thereof. Preferred solvents are both environmentally acceptable and exhibit high solubility for metal salts; an especially preferred solvent is a mixture of water and 20–80 percent 2-propanol. Preferred organic solvents include 1-methyl-2-pyrrolidinone, N,N-dimethylacetamide and acetonitrile.

Useful film-forming solutions can be prepared comprising less than 5 percent polymer, preferably less than 3 percent, say about 0.1 to 1 percent of polymer which is soluble in water or aqueous solutions of lower alcohols or which can be provided as an emulsion in such solutions. Useful water soluble polymers include cellulose derivative polymers such as methylcellulose polymers and hydroxypropyl methylcellulose polymers, vinylalcohol polymers such as hydrolyzed polyvinylacetate, e.g. 80–90% hydrolzed polyvinylacetate known as polyvinylbutyral, polyacrylic acid polymers such as partially esterified polyacrylic acid, and oxyethylene oligomers and polymers such as polyoxyethylene-derivative alkaryl nonionic surfactants. Preferred polymers which provides appropriate viscosity in solutions of water and alcohol for printing applications include hydroxypropyl methylcellulose (HPMC) and poly(vinyl butyral). Useful emulsions of water-insoluble polymers include emulsions of polystyrene, polyvinyl chloride and polybutadiene or butadiene copolymers such as nitrile rubber; an especially preferred class of emulsions comprises polymers which are crosslinkable such as carboxy-modified nitrile rubber emulsions.

Useful film-forming solutions can be prepared comprising at least 80 percent solvent and up to about 20 percent of a mixture of polymer and metal salt. Depending on the relative weight of the anion, the solution will contain up to about 10 percent metal, typically 1 to 5 percent of a Group 8 or Group 1B metal which is soluble in an aqueous solvent and readily reducible; a preferred Group 8 metal is palladium and preferred Group 1B metals include silver and gold. The metal or mixture of metals is desirably present as a soluble salt of an acid such as hydrogen iodide, hydrogen bromide, acetic acid, lactic acid, mandelic acid and cyanoacetic acid. Such acids provide anions which are converted to a volatile species on heating and/or exposure to actinic radiation. Liberation of anions facilitates reduction of the metal species allowing the formation of clusters. When lactic or mandelic acid is used as the counteranion for the metal, it is believed that reduction of the cation species to metal is facilitated by electron transfer from the anion which dissociates to an aldehyde and carbon dioxide. For instance, lactate dissociates to acetaldehyde and carbon dioxide; and mandelate dissociates to benzaldehyde and carbon dioxide. Anions which are converted to volatile species, e.g. with proton or electron transfer, are especially preferred. Volatile anion derivatives are effective in providing mirrors with a minimal amount of residual material that might adversely affect the optical qualities of the composite mirror. Preferred anions are sufficiently convertible to volatile anion derivatives so as to be substantially depleted from the film under moderate polymer processing conditions, e.g. on exposure to convective or radiant energy or sufficiently low atmospheric pressure to favor conversion to volatile by-products. Typical energy treatment includes exposure to moderate temperatures such as 100° to 300° C., exposure to actinic radiation such as U.V. light or x-rays in the presence of radiation shifting compounds. For instance, lactate anion readily dissociates to acetaldehyde (boiling point, 20° C.) and carbon dioxide, both of which are readily liberated from thin films as are used in practicing this invention.

Metal salts are selected based on solubility in the solvent. Useful gold salts include gold bromide and gold iodide; useful palladium salts include palladium acetate; and useful silver salts include silver lactate, silver mandelate, silver cyanoacetate and silver α-hydroxyisobutyrate. When aqueous based solvents are desired, it may be necessary to select a form of the acid which provides salts with higher solubility. For instance, silver salts of L-lactic acid have a higher solubility in water than the corresponding silver salt of D,L-lactic acid.

Useful film-forming solutions can optionally comprise reducing agents to facilitate the reduction of cationic metal to reduced metal species. Preferred reducing agents and/or the oxidized species are also sufficiently volatile so as to be liberated from the composite mirror; one such volatile reducing agent is acetaldehyde ammonia trimer. Depending on the metal species, the solutions can also preferably comprise metal complexing agents. When palladium or silver are used, a preferred volatile metal complexing agent is ammonia. Ammonia should not be used with gold as explosive materials are generated which make it very difficult to prepare composite mirrors. In the case of films that are processed by exposure to UV light, e.g. to convert salts to metal clusters and volatiles, it is useful to provide light shifting agents to enhance the intensity of active wavelengths of light.

For some applications it is also useful to employ radical-forming photoinitiators and/or crosslinkers. In the case of silver lactate salts, useful photoinitiators include substituted acetophenone compounds, e.g. 4-(2-hydroxyethoxy)phenyl 2-hydroxy-2-propyl ketone. In the case of hydroxy-functionalized polymers, e.g. cellulose derivatives, useful crosslinkers include titanates, e.g. titanium isopropoxide which liberate volatile alkoxide groups.

While reducing agents, complexing agents, photoinitiators, crosslinkers and anionic species or derivatives thereof used in the practice of this inventions are preferably volatile, it is not necessary that all traces of such species be liberated from the composite mirrors of this invention. For instance, the composite mirrors can comprise low levels, e.g. up to about 5 percent of anionic species and/or reducing agents, complexing agents, photoinitiators and other additives such as surfactants which are useful for promoting the film-forming character of the solutions. Preferred composite mirrors will comprise essentially polymer and metal clusters with lower residual levels of such other compounds, e.g. less than 2 percent, more preferably less than 1 percent.

For composite mirror applications where rub resistance is desired, it is useful to employ non-volatile agents such as synthetic waxes in the film forming solution. Prefered waxes are water-soluble or emulsions, e.g. mixtures of acrylic copolymers and waxes, present at up to 5 percent in the film forming solution, typically less than 3 percent.

The composite mirrors of this invention are prepared by coating a substrate with a thin layer of the film-forming solution, removing the solvent to provide a layer of a mixture of polymer and metal salt and applying energy, e.g. in the form of heat or light to convert the dispersed metal salt into clusters of reduced metal. Useful treatment for converting films to composite mirrors includes moderate heat treatment such as short term, e.g. from less than 0.5 minutes to as long as 10 minutes, exposure to an environment or fluid heated in the range of 100° to 300° C. Exposure to heat at 160° C. for 0.5 to 1 minute has typically been found to be effective for silver lactate. Another useful treatment is exposure of the polymer film to actinic radiation such as U.V. light from mercury lamps. Because E-beams typically generate arcing on metal surfaces, E-beam radiation is expected to be feasible only with layers that form non-conductive agglomerates of metal clusters. X-rays are also expected to be effective in forming metal clusters, e.g. when combined with a radiation shifting material that converts x-rays to UV. The intensity and duration of the exposure required depends on factors such as ratio of polymer to metal salt, film thickness, radiation wavelength, metal salt composition, use of UV shift additives, etc. In many cases, where UV has been found to be effective in producing composite polymeric mirrors, radiation density of 0.06 to 0.15 joules/square centimeter ($J/cm^2$) UV light from a mercury vapor lamp for a short time, e.g. from less than 0.5 seconds to as long as 10 minutes; UV exposure in the range of 1 to 15 seconds has typically been found to be effective. In many cases it is preferred to follow actinic radiation exposure with heat treatment to provide composite mirrors with higher reflectance. In some cases such treatment makes non-conductive composite mirrors conductive.

It is believed that the layer of a mixture of polymer and metal salt should not be anhydrous; that is, it is believed that a low level of moisture, e.g. as a component of the salt or as absorbed in the polymer, will facilitate the production of composite mirrors by promoting the conversion of metal salt to reduced metal species. Experience has also shown that operation in an oxygen-free atmosphere, e.g. under nitrogen, promotes a brighter tarnish-free mirror surface, at least in the case of the less noble metals such as silver.

It is not known whether cations in the polymer film are first reduced to metal species which migrate and agglomerate into clusters or whether the cations first migrate and agglomerate and then are reduced into clusters of the metal species. What is known is that the under the influence of incident energy the metal salt progressively is converted into metal clusters. Clusters of palladium, of a nominal diameter in the range of 1.5 to 4.5 nanometers, are typically dispersed in an electrically conductive layer. Clusters of silver, of a nominal diameter in a wider range of 7–100 nanometers, can be electrically conductive or insulating. For instance at lower concentrations of silver metal, e.g. about 80 to 90 percent silver, composite mirrors tend to be electrical insulators. At higher concentrations of silver metal, e.g. about 90 to 95 percent silver, composite mirrors tend to be electrical conductors.

In one application of the composite mirrors in optically variable devices of this invention, the film-forming solution is applied to a three-dimensional relief-patterned surface having an inherent holographic image which can be made visible by applying a conforming metal layer to the relief-patterned surface. The composite mirrors of this invention can be made sufficiently thin that they readily conform to such a relief-patterned surface as to allow a holographic image to be visible in light reflected from the mirror.

The brightness of composite mirrors of this invention can be characterized by the amount of light reflecting from the surface of a composite mirror. As established by the Commission International de l 'Eclairage (CIE) color is measured by analysis of the tristimuli X, Y and Z of light reflected from a sample surface under a standard illumination as seen by a standard observer. By convention the CIE established that the tristimulus Y=100 for an ideal white surface reflecting 100% at all wavelenghts. Higher quality composite mirrors are characterized by higher values of the tristimulus Y. In the following examples "Y specular reflectance" was measured using a 10° observer target in a HunterLab Ultrascan sphere spectrocolorimeter (manufactured by Hunter Associates Laboratory of Reston, Va.) with a D65 standard light source which approximates daylight having a color temperature of 6500° K. (blue-white). In practice a 10° cone of reflected light is allowed to exit the spectrocolorimeter; diffuse reflectance, i.e. all reflected light from the surface which does not exit the target window, is measured. "Y specular reflectance" was determined by subtracting the Y-axis component of diffuse reflectance from the Y-axis component of total reflectance. By way of reference, commercial vacuum aluminized films exhibit a Y specular reflectance of 80–85; reflection holograms having a mirror surface of vacuum deposited aluminum exhibit a Y specular reflectance of 64–70; and reflection holograms having a mirror surface of sputtered silver exhibit a Y specular reflectance of 71.

In the following examples "exposed to UV light" means the samples of films were exposed to UV light, e.g. to assist in processing the films to a high quality mirror by passing films through a UV light processor having a broad band, medium pressure, mercury vapor lamp and a nitrogen atmosphere. The coated side of the film faced the light source. The UV light processor was characterized by passing a radiometer having a spectral response range of 320–390 nanometers under the lamp at a linear speed of about 36 meters/minute; it was found that the processor provided an energy density of 0.066 joules/square centimeter per pass.

The disclosure in the following examples illustrate specific embodiments and aspects of this invention but is not intended to imply any limitation of the scope of this invention. In these examples HPMC refers to hydroxypropyl methylcellulose obtained from The Dow Chemical Company as K100M Controlled Release grade HPMC.

EXAMPLE 1

This example illustrates the preparation of a silver lactate salt useful in this invention. Silver carbonate and a slight excess of L-lactic acid were heated in water to liberate by-product carbon dioxide until the components were dissolved; the solution was filtered to remove residue impurities providing a clear solution of L-lactic acid, silver salt.

EXAMPLE 2

This example illustrates the production of image-reflecting, composite mirrors applied onto polymeric films. An aqueous film-forming solution was prepared by mixing a solution of 1.31 g of L-lactic acid, silver salt in 9.13 g of water with 9.25 g of a 1% HPMC aqueous solution, followed by 5.25 g of 2-propanol and 0.066 g of 4-(2-hydroxyethoxy)phenyl 2-hydroxy-2-propyl ketone (a radical-forming photoinitiator available from Ciba-Geigy as Darocur 2959). The solution was passed through a 1.2 micrometer filter and coated onto a PET film substrate using a 12.7 micrometer wire-wound rod and air dried. Samples of the dry coating which were heated in 160° C. air for between 1–2 minutes were converted to a composite mirror having a Y specular reflectance of 47. Samples of the dry coating which were exposed to UV light by 4 passes through a UV light processor were converted to a composite mirror having a dull surface with a Y specular reflectance of 34. Samples of the dry coating which were exposed to both UV light and heat (as indicated in this example) were converted to a composite mirror having Y specular reflectance of 58–60. The mirror surfaces were all non-conductive.

EXAMPLE 3

This example illustrates the effect of variations in polymer concentrations and intensity of UV light in the production of composite mirrors. A silver salt solution was prepared by dissolving 0,655 g of L-lactic acid, silver salt in 4.142 g of water; the salt solution was mixed with 5,083 g HPMC aqueous solution (0.91% HPMC), followed by the addition of 2,625 g 2-propanol; the solution was passed through a 1.2 micrometer filter. The solution (0.37% HPMC) was coated onto a PET film using a 12.7 micrometer wire-wound rod. Coated PET film was exposed to UV light with 4 passes through a UV web processor (0.066 J/cm$^2$ per pass) producing composite mirrors having a Y specular reflectance of 48; the composite mirrors were not conductive (electrical resistance exceeded 18 megaohms). When the mirrors were subsequently treated at 170° C. for 1 minute, the Y specular reflectance rose to 51 and the mirror became conductive (electrical resistance was reduced to about 300 ohms). When coated PET film was exposed to less intensive UV light (i.e. 4 passes through a UV web processor providing 0.061 J/cm$^2$ per pass), the coatings were converted to non-conductive composite mirrors having a lower Y specular reflectance of 44. When these mirrors were subsequently treated at 170° C. for 1 minute, the Y specular reflectance rose to 50 and the mirror had an electrical resistance of about 100 kiloohms.

When the above procedure was essentially repeated using less HPMC to provide a coating solution containing 0.34 % HPMC, non-conductive composite mirrors prepared by UV exposure at 0.061 J/cm$^2$ had a Y specular reflectance of 40. After heating at 170° C. for 1 minute, the Y specular reflectance rose to 55 and the electrical resistance dropped to a level in the range of 16 to 50 ohms.

EXAMPLE 4

This example illustrates the preparation of composite polymeric mirrors from solutions containing a palladium salt. A palladium solution was prepared by dissolving 2.29 g of palladium acetate in a solution of 10.58 g of water and 4 ml of concentrated ammonium hydroxide. The palladium solution was added to 18.52 g of a 1% HPMC aqueous solution and diluted with 4.65 ml of water (from rinsing of the palladium solution container) and 13.2 ml of 2-propanol. The solution was passed through a 1.2 micrometer filter and coated onto PET films using 6.3 and 12.7 micrometer wire-wound rod. The coatings were dried and heated to provide composite mirrors that were electrically conductive.

EXAMPLE 5

This example illustrates the preparation of composite mirrors using low levels of polymer. A silver salt solution was prepared using 0.655 g L-lactic acid, silver salt, 2.625 g 2-propanol, 9.22 g water and 0.01 g of an aqueous solution of 20% Triton X-100 polyoxyethylene surfactant. The solution was passed through a 1.2 micrometer filter and applied to PET films using a 12.7 micrometer wire-wound rod; the coatings were air dried. Coatings treated at 170° C. for 4 minutes were not converted to composite mirrors, apparently because the low amount of polymer does not retain sufficient moisture for effective reduction of the silver salt to silver clusters. Coatings which were passed once through a UV processor (0.066 J/cm$^2$) were converted to non-conductive composite mirrors. Conductive composite mirrors were produced after 4 passes through the UV processor.

EXAMPLE 6

This example illustrates the preparation of a printing ink useful for high speed application of composite mirrors to moving webs. A 1.0 % HPMC solution in a 50/50 mixture of 2-propanol/water was prepared by suspending powdered HPMC in vigorously stirred 2-propanol; water was slowly added to the stirred suspension to dissolve the HPMC. Then 30 g of the 1% HPMC stock solution in 50/50 2-propanol/water was slowly diluted dropwise with 30 g of 2-propanol, providing 60 g of a 2-propanol-diluted 0.5% HPMC solution. Separately, a silver salt concentrate was prepared by adding 5.24 g of L-lactic acid, silver salt to 10.8 g of concentrated ammonium hydroxide solution. After the salt had substantially dissolved, the liquid was passed through a 0.22 micrometer nylon filter then mixed into the 2-propanol-diluted HPMC solution. An additional 24 g of 2-propanol was added to make a colorless ink.

EXAMPLE 7

This example illustrates the use of solutions of this invention for making composite polymeric mirrors by high speed printing methods. Using a 4" gravure proofer press (Geiger Tool Co.), ink formulations prepared according to Example 6 were printed in patterns on paper webs having polymeric surfaces embossed with hologram-generating relief patterns. Web speed ranged from 5–50 cm/sec (10–100 feet/minute). The printed patterns were passed from the gravure roll, exposed to UV and heat (up to 200° C.) in a 2.4 meter long oven, providing composite polymeric mirror patterns on the webs having Y specular reflectance of about 24. Webs were also processed offline by drying the printed pattern at low heat, followed by exposure to high intensity UV light and heat at 180° C. for up to 10 minutes, providing composite polymeric mirrors on the webs having Y specular reflectance of about 32.

EXAMPLE 8

The printing methods of example 7 were repeated on webs of polyester (PET) film. Web with printed patterns was passed from the gravure roll, exposed to UV and heat (up to 200° C.) in a 2.4 meter long oven, providing composite polymeric mirror patterns on the webs having Y specular reflectance of about 36. Webs were also processed offline by drying the printed pattern at low heat, followed by exposure to high intensity UV light and heat at 180° C. for up to 10 minutes, providing composite polymeric mirrors on the PET webs having Y specular reflectance of about 43.

EXAMPLE 9

The procedure of example 7 was essentially repeated using a palladium salt solution prepared by adding 6.33 g of palladium acetate to 21.56 g of concentrated aqueous ammonium hydroxide solution. The palladium solution was filtered (0.22 micrometer nylon filter) and added to 52.11 g of HPMC in a water/2-propanol solution, prepared by diluting 30 g of 1% HPMC in 50/50 water/2-propanol with 22.11 g water and 10 g 2-propanol. The palladium/HPMC solution diluted with 10 g water was printed onto PET film travelling at about 5 cm/sec. The printed patterns were passed from the gravure roll, exposed to UV and heat (up to 200° C.) in a 2.4 meter long oven, providing composite polymeric mirror patterns on the webs having Y specular reflectance of about 17. Webs were also processed offline by drying the printed pattern at low heat, followed by exposure to high intensity UV light and heat at 180° C. for up to 10 minutes, providing composite polymeric mirrors on the webs having Y specular reflectance of about 21.

EXAMPLE 10

Figure 2:
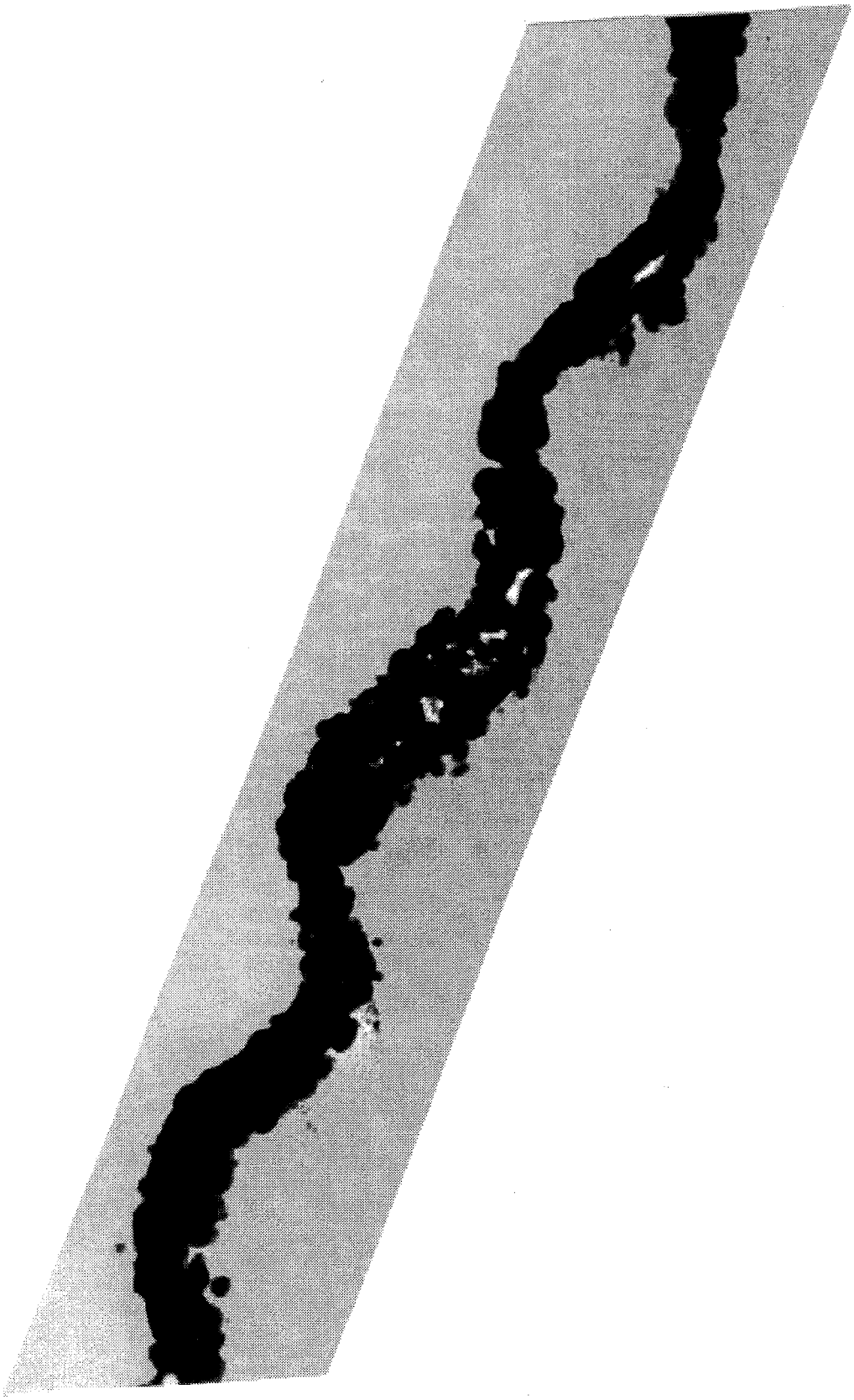
FIG. 2 is an electron photomicrograph showing the cross section of a composite mirror according to this invention applied to a reflection hologram.

This example illustrates the preparation of an optically variable device, e.g. a reflection hologram, comprising a composite mirror according to this invention. 60 g of a 1% stock solution of HPMC prepared as in Example 6 was diluted dropwise with 60 g of 2-propanol. A silver salt solution was prepared by adding about 21 g of L-lactic acid, silver salt to about 43 g of concentrated ammonium hydroxide solution. The silver salt solution and about 16 g of 2-propanol were added to the diluted HPMC solution, providing a solution that was applied to a web having hologram image-forming, relief pattern using the printing method of Example 7 providing a web with reflection holograms where the holographic image is reflected from a composite mirror which conforms to and replicates the hologram image-forming relief pattern. FIG. 2 is an electron micrograph of a cross section of the-hologram showing as a dark band on a wave surface the composite mirror of silver clusters. The peak to peak dimension of the wave surface of the relief pattern is about 430 nanometers; the amplitude of the wave pattern is about 85 nanometers; and the thickness of the composite mirror ranges from 20 to 50 nanometers.

EXAMPLE 11

This example illustrates the preparation of composite mirrors from solutions containing a volatile reducing agent. A silver solution was prepared by dissolving 0.655 g L-lactic acid, silver salt in 7.225 g water. To the silver solution was added 4.625 g of a 1% HPMC aqueous solution, followed by 0.102 g of acetaldehyde ammonia trimer as a reducing agent and 0.012 g of an aqueous solution of 20% Triton X-100 surfactant. The solution was passed through a 1.2 micrometer filter and coated onto a PET sheet using a 12.7 micrometer wire-wound rod. The coating was dried and exposed to UV light with 4 passes through a UV processor at 36 meters/minute, providing a composite mirror with a dull finish which was not electrically conductive. The composite mirror was exposed to 160° C. air for 1 minute providing a bright mirror finish which was electrically conductive.

EXAMPLE 12

This example illustrates the preparation of composite polymeric mirrors from organic solvent solutions. 1.31 g of L-lactic acid, silver salt and 23 drops of pyridine (0.61 g) were added to a mixture of 11.8 g of N,N-dimethylacetamide and 11.8 g of acetonitrile. When the mixture became homogeneous with mixing, 0.0925 g of poly(vinyl acetate) was added, providing a film-forming solution which was passed through a 1.2 micrometer filter and coated onto a PET sheet using a 12.7 micrometer wire-wound rod. The solution was air dried to a film then exposed to UV light, producing a composite polymeric mirror.

EXAMPLE 13

This example illustrates the preparation of composite polymeric mirrors from polymer emulsions. 0.23 g of a vinyl acetate-ethylene emulsion (Airflex 405 emulsion, 55% solids, obtained from Air Products & Chemicals, Inc.) was diluted with 12 g of water. 10.3 g of a 10% solution L-lactic acid, silver salt in water was added dropwise to the diluted emulsion to form a solution which was applied as coatings to PET sheets. The coatings were air dried. Composite polymeric mirrors were provided when coatings were exposed to UV light.

EXAMPLE 14

This example illustrates the preparation of composite mirrors from solutions comprising gold. A mixture of 0.852 g of gold hydroxide, 0.38 g of water and 2.27 g of hydrogen bromide was stirred to dissolve the gold. 1.5 g of an aqueous solution of 2% poly(vinyl alcohol), molecular weight 125,000, was added to the gold solution to provide a solution containing 1.5 g of polymer. The polymer/gold solution was passed through a 1.2 micrometer filter and coated onto PET sheets using a 6.4 micrometer wire-wound rod. The coatings were air dried. Composite polymeric mirrors were provided when coatings were exposed to UV light or heated at 190° C.

COMPARATIVE EXAMPLE 15

Figure 1B:
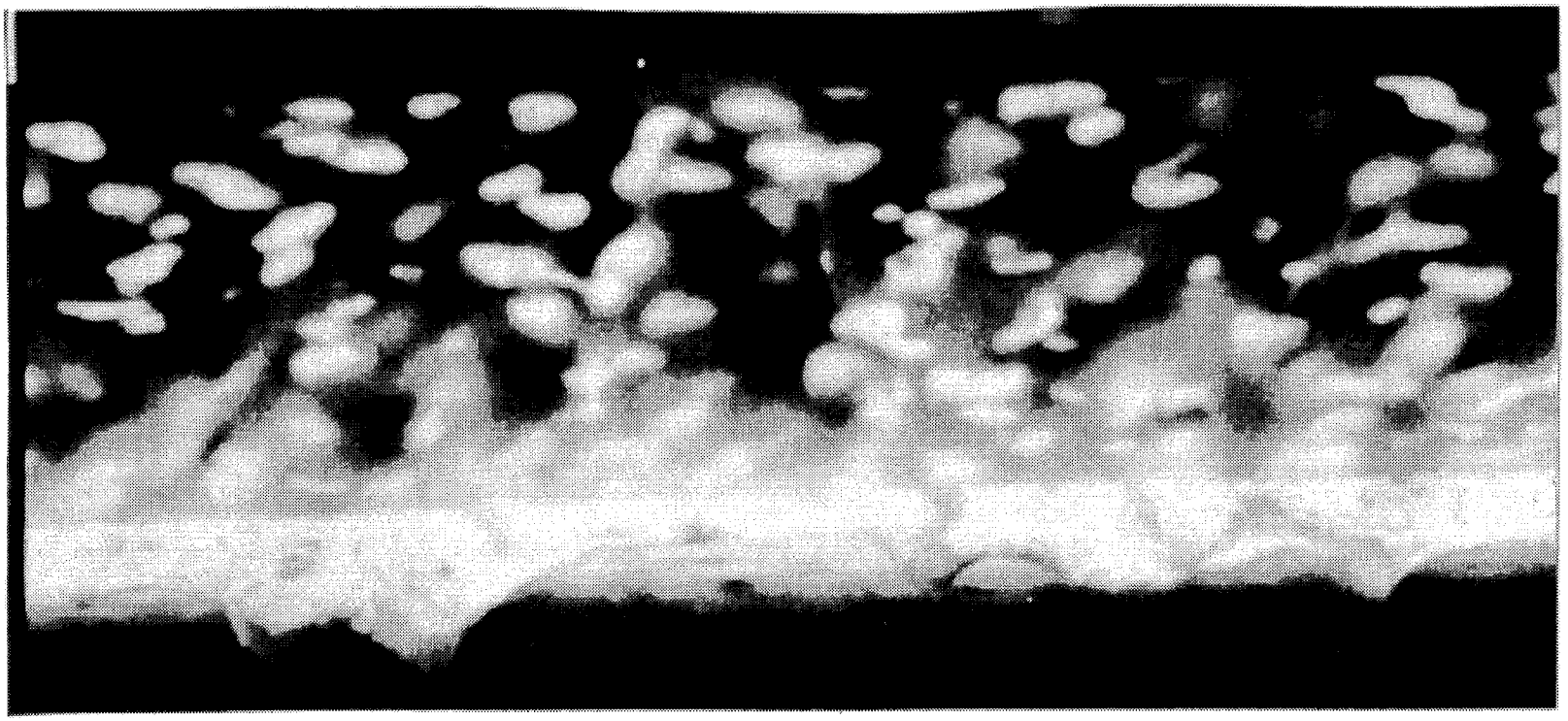

This example illustrates the preparation of metallic gloss coatings according to Honda Motor Company, Ltd's Japanese Kokai Tokkyo Koho 81/70,884. A resin solution was prepared by mixing 8.5 g poly(methyl methacrylate) (obtained from Aldrich, medium molecular weight) 12 g xylene, 4.3 g 1-butanol, 4.2 g Resimene 881 melamine resin (from Monsanto Company) and 1.1 g silicone oil (BYK 301 polyether modified dimethylsiloxane copolymer obtained from BYK-Chemie). A silver solution was prepared by dissolving 2.5 g silver nitrate in a mixture of 7.5 g methyl Cellosolve (2-methoxyethanol) and 10.0 g Carbitol (2-(2-ethoxyethoxy) ethanol). A mixture of the resin solution and the silver solution was coated on a polyimide film using a 50 micrometer wet film bar. The coating was air dried at room temperature for 20 minutes, heated at 80° C. for 20 minutes, then heated for 30 minutes at 220° C., producing a polymer film with a silver outer layer as shown in the electron photomicrographs of FIGS. 1*a* and 1*b*.

While specific embodiments have been described herein, it should be apparent to those skilled in the art that various modifications thereof can be made without departing from the true spirit and scope of the invention. Accordingly, it is intended that the following claims cover all such modifications within the full inventive concept.

What is claimed is:

1. A hologram comprising a polymeric substrate having a relief-patterned, image-forming surface coated with a light-reflecting composite mirror layer consisting of a mixture of a up to 20 weight percent of polymer and at least 80 weight percent of metal clusters having a nominal diameter less than 100 nanometers, wherein said metal clusters are agglomerated in a layer conforming to said relief-patterned, image-forming surface so that light reflects from said mirror in a holographic image.

2. A hologram according to claim 1 wherein said clusters are generally spherical and have an average diameter less than 50 nanometers.

3. A hologram according to claim 1 printed on a security document.

* * * * *